United States Patent [19]

Lakin

[11] Patent Number: 4,691,679

[45] Date of Patent: Sep. 8, 1987

[54] FUEL INJECTION PUMPING APPARATUS

[75] Inventor: David F. Lakin, London, England

[73] Assignee: Lucas Limited public limited company, Birmingham, England

[21] Appl. No.: 753,548

[22] Filed: Jul. 10, 1985

[30] Foreign Application Priority Data

Jul. 13, 1984 [GB] United Kingdom ..... 8417860

[51] Int. Cl.[4] ..... F02M 41/14

[52] U.S. Cl. ..... 123/450; 123/503; 123/506; 417/462; 417/499

[58] Field of Search ..... 123/450, 503, 506; 417/289, 462, 494, 499

[56] References Cited

U.S. PATENT DOCUMENTS

| | | | |
|---|---|---|---|
| 3,146,715 | 9/1964 | Knudson | 123/450 |
| 3,204,561 | 9/1965 | Roosa | 123/450 |
| 3,663,123 | 5/1972 | Fenne | 417/462 |

FOREIGN PATENT DOCUMENTS

| | | | |
|---|---|---|---|
| 857970 | 1/1961 | United Kingdom | 123/450 |
| 2073331 | 10/1981 | United Kingdom | 123/450 |

*Primary Examiner*—Andrew M. Dolinar

[57] ABSTRACT

A fuel injection pumping apparatus of the rotary distributor type has a positively reciprocated pumping plunger slidable in a bore in the distributor member which is housed in a body part. The body part has a cylinder housing a piston resiliently biased towards an end wall. A recess in the end of the piston presented to the end wall can be connected to the bore by the plunger at a variable position during the delivery of fuel by the plunger and the cylinder has an enlarged end portion adjacent the end wall. The enlarged portion communicates with the bore during the pumping stroke of the plunger and rapid termination of fuel delivery is obtained when the recess is connected to the bore, due to movement of the piston away from the end wall.

5 Claims, 2 Drawing Figures

FUEL INJECTION PUMPING APPARATUS

This invention relates to a fuel injection pumping apparatus for supplying fuel to an internal combustion engine and of the kind comprising a rotary distributor member housed in a body part and arranged in use to be driven in timed relationship with an associated engine, a pumping plunger housed within a bore in the distributor member, a cam ring for imparting inward movement to the plunger to displace fuel from the bore, a delivery passage in the distributor member for registration with an outlet port in the body part during successive inward pumping strokes of the pumping plunger, means for supplying fuel to the bore during a filling stroke of the plunger and further means for adjusting the amount of fuel supplied through the outlet.

The object of the invention is to provide such an apparatus in a simple and convenient form.

According to the invention an apparatus of the kind specified includes a piston slidable within a cylinder, resilient means biasing the piston into contact with an end wall at one end of the cylinder, said one end of the cylinder being enlarged to define a chamber communicating with said bore during the pumping stroke of the plunger, a recess defined between said piston and said end wall when the piston is in contact with said end wall, a passage opening onto said end wall to communicate with said recess and valve means formed by said plunger for connecting said passage with said bore during the inward movement of the plunger, said plunger being adjustable whereby the instant during the inward movement of the plunger at which the passage is connected with the recess can be varied, the arrangement being such that when during inward movement of the pumping plunger, said passage is connected to the bore, the piston is subjected to the pressure in the bore and is moved outwardly thereby reducing the pressure in the bore and terminating the flow of fuel through said outlet.

An example of a pumping apparatus in accordance with the invention will now be described with reference to the accompanying diagrammatic drawings in which.

Figures 1, 2:
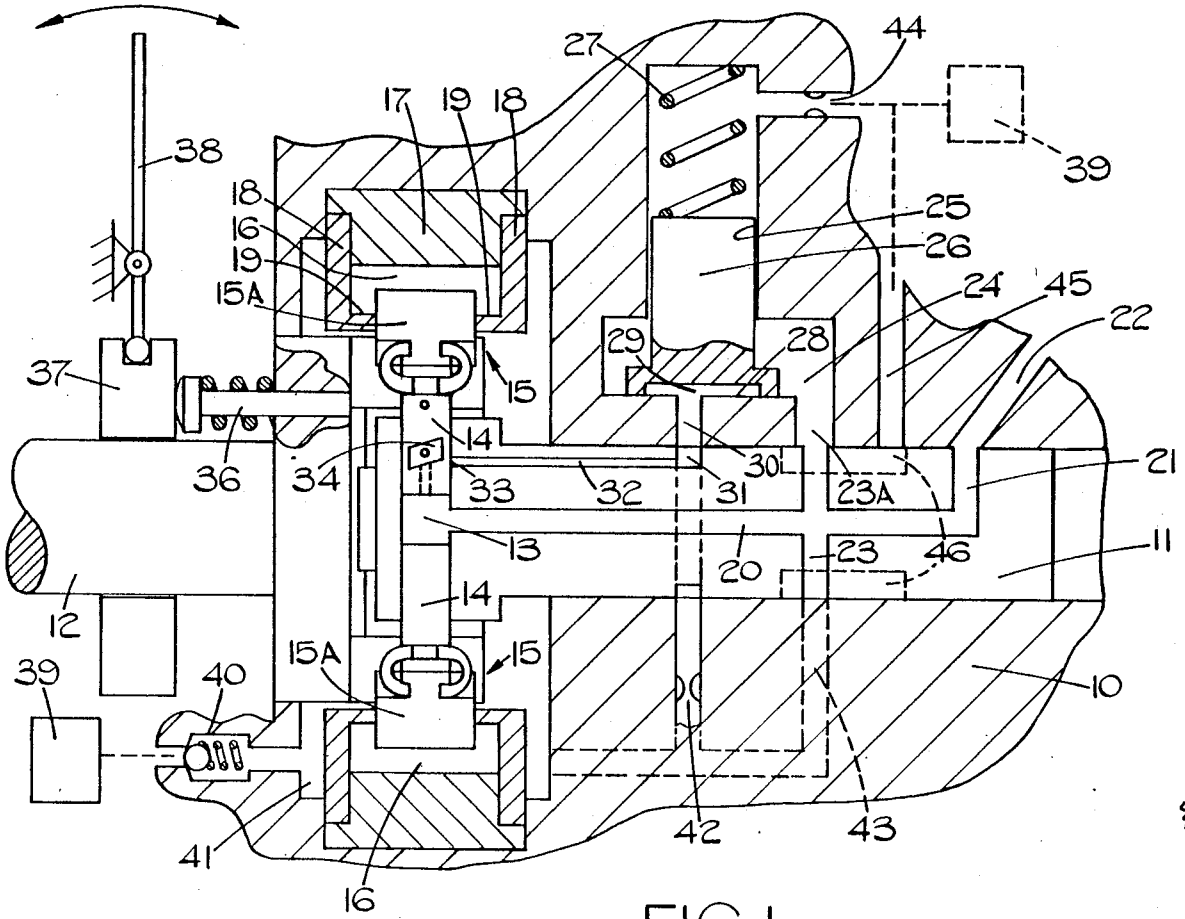
FIG. 1 is a sectional side elevation of the apparatus.
FIG. 2 is a plan view of part of the apparatus of FIG. 1.

Referring to the drawing the apparatus comprises a body part 10 in which is mounted a rotary cylindrical distributor member 11 which is coupled to a drive shaft 12 adapted in use to be driven in timed relationship with an associated engine.

Formed within the distributor member is a transverse bore 13 in which is mounted a pair of pumping plungers 14.

The outer ends of the pumping plungers 14 are coupled to cam followers generally indicated at 15 and which include shoes 15A which carry captive rollers 16 engageable with the internal peripheral surface of a surrounding cam ring 17. Also associated with the cam ring 17 is a pair of subsidiary cam rings 18 which have portions defining cam surfaces 19 presented to the roller and facing the internal peripheral surface of the cam ring 17. The cam ring 17 is provided with a plurality of equiangularly spaced cam lobes whereby as the distributor member rotates, inward movement will be imparted to the plungers 14. The surfaces 19 are generally complementary to the internal surface of the cam ring 17 and co-operate with the rollers to effect positive outward movement of the plungers 14. The plungers 14 therefore partake of a fixed stroke and are moved inwardly and outwardly as many times per revolution of the distributor member, as there are cam lobes.

During inward movement of the pumping plungers 14, fuel is displaced from the bore 13 and flows along a longitudinal passage 20 to a radially disposed delivery passage 21 which can register in turn with a plurality of outlets 22 formed in the body part and which are connected in use to the injection nozzles respectively of the associated engine. There are as many cam lobes on the cam ring 17 as there are outlets.

Also formed in the distributor member is a plurality of radially disposed and equiangularly spaced passages 23 which at their inner ends communicate with the passage 20. During inward movement of the plungers 14 a passage 23 registers with a port 23A which communicates with a chamber 24 defined in the body part and which forms the enlarged end of a cylinder 25 in which is located a piston 26. The piston 26 is biased by a spring 27 towards an end wall 28 of the chamber 24 and within the chamber the piston 26 has an enlarged portion in the face of which is formed a recess 29. A passage communicates with the recess 29 the passage including a passage portion 30 formed in the body part and which is in constant communication with a circumferential groove 31 in the distributor member. The passage further includes a passage portion 32 in the distributor member and which extends to a port 33 formed in the wall of the bore 13 from the groove 31.

One of the plungers 14 is provided with a helical control groove 34 which is in constant communication with the portion of the bore 13 lying between the plungers and which can register at some point during the inward movement of the plungers, with the port 33. The particular plunger is angularly adjustable by the fact that it is provided with an arm 35 engageable with a push rod 36 which rotates with the distributor member and drive shaft and which is spring biased into contact with a control ring 37 mounted about the drive shaft. The control ring 37 is axially displaceable by means of a pivotal lever 38.

The apparatus also includes a source of fuel under pressure 39 the outlet of which is connected by way of a non-return valve 40 to a chamber 41 defined in the body part and surrounding the portion of the distributor member which defines the bore 13. The groove 31 is in constant communication with this chamber by way of a restricted orifice 42 and positioned to register in turn with the passages 23 during the filling stroke of the plungers 14 is a passage 43 in the body part which also communicates with the chamber 41. Finally, the end of the cylinder 25 containing the spring is in communication with the source of fuel 39 by way of a restricted orifice 44 and a passage 45 in the body part also communicates with the source 39 and opens onto the periphery of the distributor member at a position so that grooves 46 on the distributor member can register therewith, the grooves 46 being equal in number to the passages 23 and communicating with the chamber 24.

Considering now the operation of the apparatus. In the position shown in the drawing the plungers 14 are being moved inwardly and fuel is being displaced from the bore 13 by way of the passages 20 and 21 to an outlet 22. Since the plungers 14 are moving inwardly, the volume of the space 41 is increasing and therefore fuel is being drawn into the chamber past the nonreturn valve 40, from the source 39. Since a passage 23 is in register with the port 23A, the pressure in the chamber 24 is equal to the pressure developed by the inward movement of the pumping plungers 14. However, the piston 26 is held in firm engagement with the end wall 28 by the pressure in the chamber 24, the recess 29 being connected by way of the orifice 42, with the chamber 41. When however the groove 34 communicates with the port 33 the pressure in the recess 29 is raised to that in the bore 13 and the piston is unbalanced so that it moves against the action of the spring 27 due to the pressure in the chamber 24. The fact that the piston 26 can move reduces the pressure of fuel in the bore 13 and the reduction in pressure is such that the valve member in the injection nozzle receiving fuel closes and the supply of fuel to the associated engine ceases. The pumping plungers 14 continue to move inwardly and the fuel displaced from the bore 13 merely moves the piston 26 further against the action of its spring.

As the distributor member continues to rotate the passage 21 moves out of register with an outlet 22 and a passage 23 is moved out of communication with the port 23A but a further passage 23 is moved into communication with the passage 43. Moreover, one of the grooves 46 is brought into communication with the port 23A and connects the chamber 24 to the passage 45. As the plungers are moved outwardly by the action of the cam surfaces 19, fuel flows to the bore 13 from the chamber 41 by way of the passage 43 and a passage 23. Moreover, the force exerted by the spring 27 on the piston 26 is sufficient to cause displacement of fuel from the chamber 24 back to the source 39 and the piston moves into the position in which it is shown against the end wall 28. The portion of the bore 13 intermediate the plungers is completely filled with fuel. The distributor member continues to rotate and the cycle of operation is repeated.

By altering the angular setting of the plunger 14 which is provided with the helical groove 34, the amount of fuel which is displaced to the associated engine before the port 33 is brought into communication with the bore 13, can be varied and hence the quantity of fuel supplied to the associated engine at each injection stroke of the pump can be varied. The timing of delivery of fuel is controlled by adjusting the angular setting of the cam ring 17 and of course the rings 18. This adjustment can be effected in any convenient manner for example, by a fuel pressure actuated piston. Moreover, the movement of the rod 36 which controls the angular setting of the plunger 14, can be effected by any convenient means such for example as an electrically controlled device.

The passage containing the restricted orifice 42 and the orifice can be omitted if the leakage around the distributor member is sufficient to absorb the fuel leaking around the plunger and into the port 33 during the pumping stroke of the plunger. It is of course essential to avoid a pressure build up in the recess 29 otherwise the piston 26 might start to move before required the groove 34 is brought into communication with the port 33.

I claim:

1. A fuel injection pumping apparatus for supplying fuel to an internal combustion engine comprising a body part, a rotary distributor member housed in the body part and arranged in use to be driven in time relationship with an associated engine, a pumping plunger housed within a bore in the distributor member, a cam ring for imparting inward movement to the plunger to displace fuel from the bore, a delivery passage in the distributor member for registration with an outlet port in the body part during successive inward pumping strokes of the pumping plunger, means for supplying fuel to the bore during a filling stroke of the plunger, a piston slidable within a cylinder, resilient means biasing the piston into contact with an end wall at one end of the cylinder, said one end of the cylinder being enlarged to define a chamber communicating with said bore during the pumping stroke of the plunger, a recess defined between said piston and said end wall when the piston is in contact with said end wall, a passage opening onto said end wall to communicate with said recess, and which is closed off from said chamber when the pistion is in contact with said end wall, a restrictor through which said passage communicates with a low pressure source, valve means formed by said plunger for connecting said passage intermediate said restrictor and said recess with said bore during the inward movement of the plunger, said plunger being adjustable whereby the instant during the inward movement of the plunger at which the passage is connected with the recess can be varied, the arrangement being such that when during inward movement of the pumping plunger, said passage is connected to the bore, the pressure in said recess will be increased to allow movement of the piston away from said end wall, the piston moving outwardly in the cylinder thereby reducing the pressure in the bore and terminating the flow of fuel through said outlet.

2. An apparatus according to claim 1 including further valve means defined by the distributor member and a port in the body part opening onto said distributor member and connected to said one end of the cylinder said further valve means acting to connect said port with said bore during the pumping stroke of the plunger and with a low pressure source during the filling stroke of the plunger, said resilient means acting to urge the piston into contact with said end wall while the port is in communication with the low pressure source.

3. An apparatus according to claim 2 in which said further valve means comprises a plurality of angularly spaced passages in the distributor member which communicate with said bore and open onto the periphery of the distributor member at a position to communicate with said port, and a plurality of channels on the distributor member which are alternately positioned to said plurality of passages.

4. An apparatus according to claim 3 including a further chamber defined in said body part, the volume of said further chamber increasing during the pumping stroke of the plunger, a non return valve through which fuel can flow into said further chamber as the volume thereof increases, and a passage in the body part connected with said chamber, said passage opening onto the periphery of the distributor member at a position to register with one of said plurality of passages during the filling stroke of the pumping plunger whereby fuel will be displaced from said chamber to the bore.

5. An apparatus according to claim 1 in which said plunger is provided with a helical groove connected with said bore, said groove registering with a port in the wall of the bore, the port communicating with said passage, to place said recess in communication with said bore, said plunger being angularly adjustable to control the quantity of fuel supplied through the outlet.

* * * * *

UNITED STATES PATENT AND TRADEMARK OFFICE

CERTIFICATE OF CORRECTION

PATENT NO. : 4,691,679

DATED : Sept. 8, 1987

INVENTOR(S) : David F. Lakin

It is certified that error appears in the above-identified patent and that said Letters Patent are hereby corrected as shown below:

ON THE TITLE PAGE ASSIGNEE SHOULD READ:

[73] Assignee: LUCAS INDUSTRIES public limited company, Birmingham, England

Signed and Sealed this

Sixteenth Day of February, 1988

*Attest:*

*Attesting Officer*

DONALD J. QUIGG

*Commissioner of Patents and Trademarks*